United States Patent [19]

Harrigan

[11] 3,955,752

[45] May 11, 1976

[54] LOCKING ENVELOPE

[75] Inventor: Richard V. Harrigan, Tonawanda, N.Y.

[73] Assignee: Niagara Envelope Company, Buffalo, N.Y.

[22] Filed: Apr. 28, 1975

[21] Appl. No.: 572,142

[52] U.S. Cl. ..... 229/84

[51] Int. Cl.[2] ..... B65D 27/22

[58] Field of Search ..... 229/75, 76, 77, 80, 229/82, 84

[56] References Cited

UNITED STATES PATENTS

| | | | |
|---|---|---|---|
| 180,200 | 7/1876 | Chapman | 229/76 X |
| 1,090,639 | 3/1914 | Miyanaga | 229/80 |
| 1,129,653 | 2/1915 | Drygas et al. | 229/82 |
| 3,220,637 | 11/1965 | Yam Yee | 229/76 |
| 3,236,440 | 2/1966 | Yam Yee | 229/82 |
| 3,356,285 | 12/1967 | Greason | 229/80 |
| 3,756,504 | 9/1973 | Bock | 229/84 X |

FOREIGN PATENTS OR APPLICATIONS

| | | | |
|---|---|---|---|
| 288,429 | 4/1928 | United Kingdom | 229/76 |
| 335,098 | 9/1930 | United Kingdom | 229/76 |
| 361,919 | 12/1906 | France | 229/76 |
| 723,493 | 4/1932 | France | 229/76 |
| 417,304 | 2/1967 | Switzerland | 229/82 |

*Primary Examiner*—William Price
*Assistant Examiner*—Stephen Marcus
*Attorney, Agent, or Firm*—Christel & Bean

[57] ABSTRACT

An easily opened, non-adhesively closed envelope includes a closure flap extending from the top front edge thereof with a tuck flap extending from the outer edge of such closure flap. A locking flap is disposed in a downfolded, overlying manner from the top back edge of the envelope and, being adhesively attached to only one side edge of the envelope, provides an open-ended pocket into which the tuck flap is inserted. The tuck flap is held between the back of the envelope and the inner side of the locking flap in sandwich fashion so as to maintain the envelope in a closed disposition. The tuck flap is offset from the centerline of the envelope towards the side edge thereof adjacent to which the locking flap provides the open pocket for receiving the tuck flap. Increased facility of engaging and disengaging the tuck flap from the open pocket defined by the locking flap is thereby provided.

7 Claims, 9 Drawing Figures

Fig. 3.
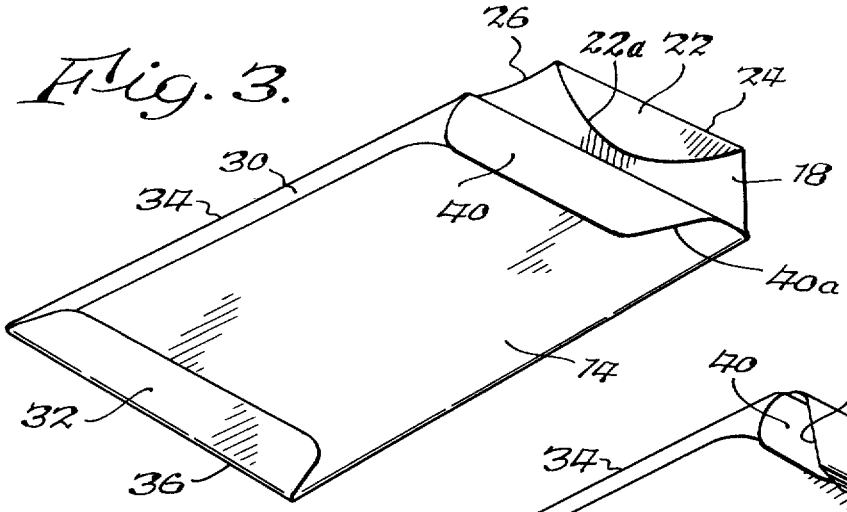
Fig. 4.
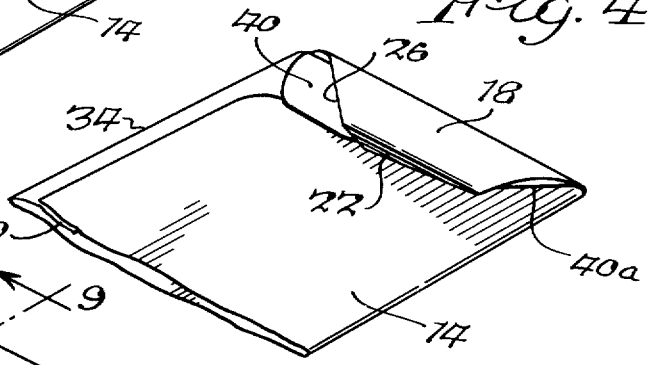
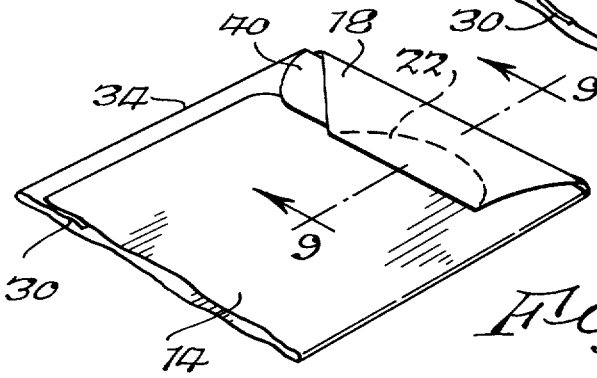
Fig. 5.
Fig. 6.
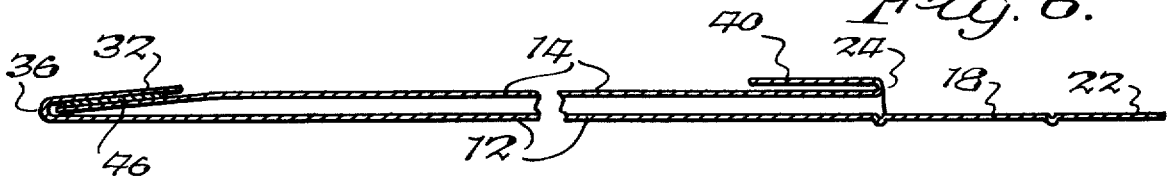
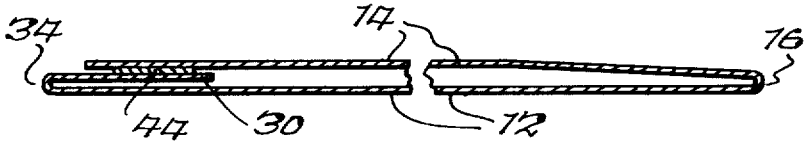
Fig. 7.
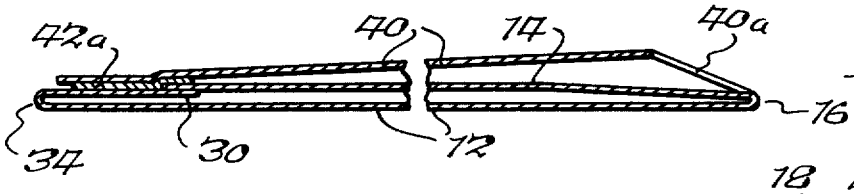
Fig. 8.
Fig. 9.
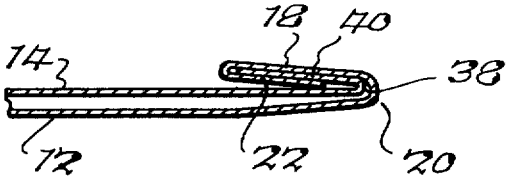

LOCKING ENVELOPE

BACKGROUND OF THE INVENTION

The present invention is generally concerned with an envelope having a top closure means for affirmatively retaining the contents of the envelope therein. More specifically, the present invention deals with an envelope in which the aforesaid closure top portion can be engaged in a non-adhesive manner and may be disengaged in a simplified manner by the user thereof.

The prior art includes numerous types of envelopes of various designs, all of which have respective design features applicable to specific purposes for which such various envelopes are utilized. It is contemplated that the envelope of the present invention will be specifically utilized in drive-in bank window situations in which money is passed in a "drive-in bank envelope" between the bank window and an automobile. In such a situation it becomes highly desirable that a closure flap be provided on the envelope to retain the contents of such envelope therein. The prior art has provided envelopes for this purpose which have included simple fold-down flaps on the top of the envelope with adhesive means for sealing the flap against the back of the envelope when in the downfolded position.

Additionally, the prior art includes envelopes having downfolding closure flaps which can be secured to the back of the envelope by mechanical locking of the closure flap to the back panel.

However, all of the prior art envelopes specifically utilized for drive-in bank window applications and for other similar uses in general have included various undesirable features. Specifically, those envelopes having closure flaps which are adhesively secured to the back of the envelope usually must first be "licked" by the individual initially utilizing the envelope wherein the receiver of such envelope must exert a certain amount of effort to either rip the envelope open or slit open the top edge in order to gain access to the contents thereof. In those envelopes having mechanical means for attaching closure flaps to the back panels thereof, such mechanical locking attachments involve folding portions of a closure flap into specifically designed mating locking portions on the envelope in a complicated manner with correspondingly complicated disengagement of such flap also being encountered.

SUMMARY OF THE INVENTION

A general object of the present invention is to provide an envelope having a fold down closure flap and a tuck flap depending therefrom which is easily engaged beneath a locking flap on the back panel of the envelope and furthermore is easily disengaged therefrom.

Another object of the present invention is to provide an envelope which, when closed, will securely hold the contents therein against possible loss and without the use of additional or extraneous fastening means and which will not, though roughly handled, accidentally open so that the money, papers or other contents would be released therefrom.

Yet another object of the present invention is to provide a closure locking arrangement for an envelope which can be readily opened and the contents removed from such envelope without mutilating the latter to such an extent as to preclude its subsequent use.

A still further object of the present invention is to provide an envelope which is extremely simple in construction, manufactured at small costs, is durable as well as highly serviceable and convenient in actual use as to be described hereinbelow.

In summary, the present invention provides an envelope produced from a single paper blank. The envelope has substantially equal sized front and back panels with the edges thereof being joined by a common fold line and adhesive closure means. A closure flap is provided on the top front edge of the envelope which includes a tuck flap depending outwardly therefrom. A locking flap is folded downwardly from the top back edge along the back panel and is secured thereto hold the aforesaid tuck flap against the back panel in sandwich type fashion in order to maintain the envelope in a closed disposition. The locking flap is adhesively sealed to the adjacent back panel section at one of its side edge portions with the opposite side edge portion of the locking flap being free to bend outwardly from the surface of the back panel of the envelope. The tuck flap, being an integral extension of the closure flap, is offset from the longitudinal centerline of the envelope towards the unsecured side edge portion of the locking flap. When the closure flap, being wider than the locking flap, is brought into overlying relation to the locking flap, the tuck flap is very easily introduced behind the unsecured side edge portion of the locking flap, the latter being readily bent away from the back of the envelope to receive the tuck flap thereunderneath. In this manner the tuck flap is slipped into a sandwich type of disposition between the back panel and locking flap whereby the envelope is closed. For facilitating the opening of the envelope closure elements, the closure flap is recessed at its side edge portion opposite from the unsecured side edge portion of the locking flap. A user of the envelope may thereby easily insert his finger between the closure flap and the outer surface of the locking flap in a direction towards the unsecured side edge portion of the locking flap so as to spring the tuck flap and necessarily the closure flap out of engagement with the locking flap.

BRIEF DESCRIPTION OF THE DRAWINGS

FIG. 3 is a perspective view, similar to FIG. 2, illustrating the initial folding of the closure and tuck flaps in order to secure such closure elements into a locked condition with respect to the locking flap of the envelope;

FIG. 4 is a fragmentary perspective view, similar to FIGS. 2 and 3, showing the tuck flap partially engaged beneath the unsecured side edge portion of the locking flap;

FIG. 5 is a fragmentary perspective view, similar to FIGS. 2, 3 and 4, with the tuck flap shown in dotted lines fully engaged beneath the locking flap of the envelope;

FIG. 6 is an elevational view in section taken about on line 6—6 of FIG. 2;

FIG. 7 is a transverse view in elevation of the envelope taken about on line 7—7 of FIG. 2;

FIG. 8 is also a transverse elevational view in section showing the folded engagement of the locking flap with the back of the envelope as taken about on line 8—8 of FIG. 2; and FIG. 9 is a fragmentary longitudinal view in section taken about on line 9—9 of FIG. 5 showing the tuck flap in a fully engaged disposition beneath the locking flap of the envelope.

DETAILED DESCRIPTION OF A PREFERRED EMBODIMENT

Figure 1:
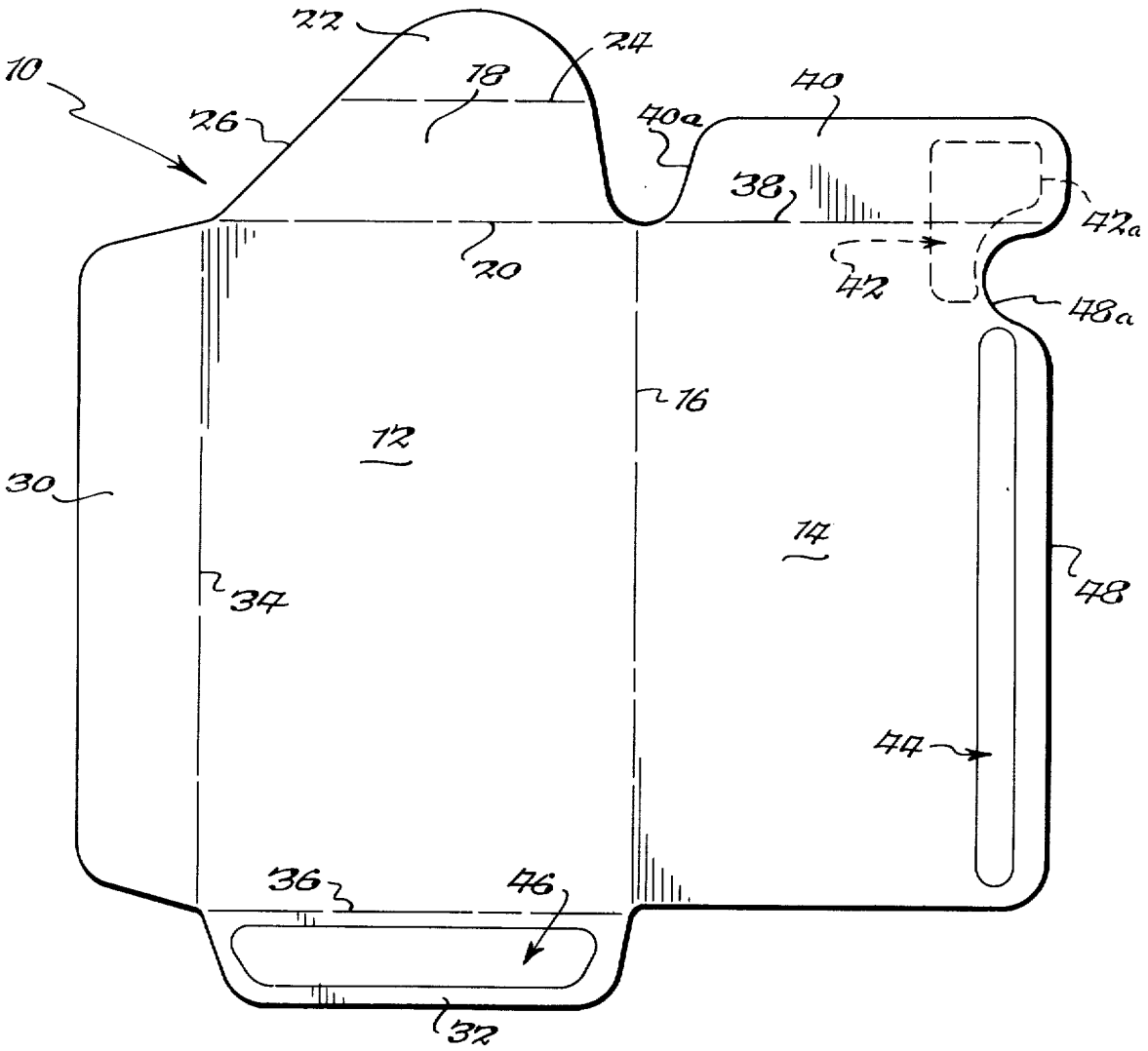
FIG. 1 is a top plan view of an envelope blank formed of a single sheet of paper which is adapted to be folded to form the envelope of the present invention.

Referring now in detail to the illustrative embodiment depicted in the accompanying drawings, there is shown in FIG. 1 a single sheet of paper generally indicated as 10 from which the envelope constituting the present invention is formed. More specifically, a front panel 12 includes a back panel portion 14 attached along one side thereof on a common fold line 16. As viewed in FIG. 1, both the front and back panels have top and bottom edges and side edges with the edge denoted by fold line 16 being common to one another. Attached along the top edge of panel 12 is a closure flap 18. The closure flap 18 is attached to panel 12 along inner edge 20 and includes a tuck flap 22 depending from outer edge 24. The inner and outer edges 20 and 24 of the closure flap 18 are shown as substantially parallel to one another with the side edge portions 26 and 28 of the closure flap being cut obliquely to such inner and outer edges so that the closure flap is substantially trapezoidal in shape. In addition to the panel 14 and closure flap 18, panel 12 includes common fold lines with sealing flaps 30 and 32 attached to side edge 34 and bottom edge 36 respectively. The top edge 38 of panel 14 includes a commmon fold line with locking flap 40. As shown on the right hand edge portion and upper right hand edge portion of locking flap 40 and panel 14 respectively in FIG. 1, an area of adhesive material or substance is provided on the far or reverse sides of such areas and is generally indicated as 42. Additionally, areas of adhesive substance are provided along the right hand edge of panel 14 as shown in FIG. 1 at 44 and is located on the frontal surface of panel 14. A third area of adhesive substance is also provided on the frontal surface of sealing flap 32 and is indicated as 46.

Figure 2:
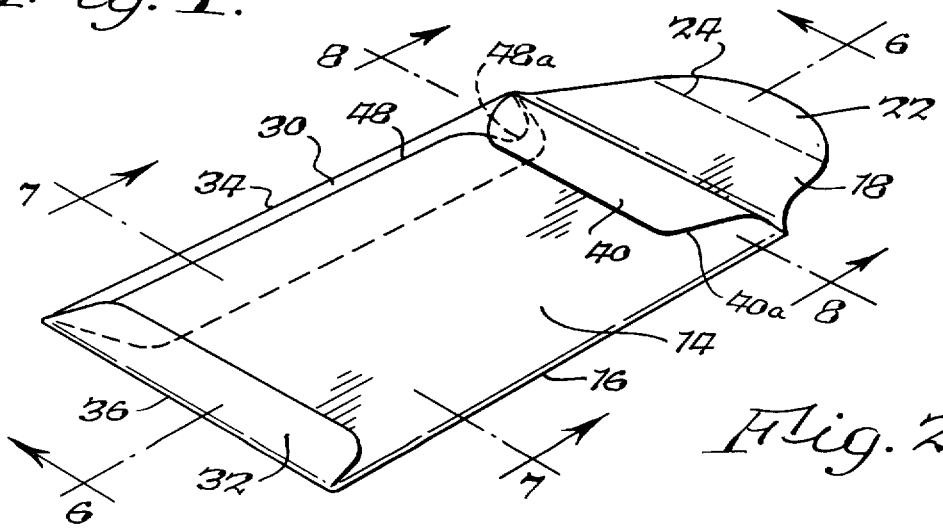
FIG. 2 is a perspective view of the front and back panels and their respective edges in an assembled disposition with the locking flap folded downwardly into overlying relation with respect to the back panel of the envelope.

Turning now to FIG. 2 of the drawings, the cutout sheet 10 is shown in folded form. In order to provide the envelope shown in FIG. 2, sealing flap 30 is first folded inwardly along side edge 34 of panel 12. Secondly, panel 14 is folded over into juxtaposed position with respect to underlying panel 12 with the adhesive area 44 thereon engaging the underlying surface of sealing flap 30. Subsequent to the folding of panel 14, sealing flap 32 is folded upwardly along the bottom edge 36 of panel 12 so that the adhesive means or area 46 thereon engages the underlying surface area of panel 14 while the locking flap 40 is downfolded along the top edge 38 of panel 14 into overlapping, juxtaposed or adjacent relationship to the upper portion of panel 14. It is to be appreciated from viewing FIGS. 1 and 2 together that the extreme outer or side edge portion **42*a* of the adhesive means on locking flap 40 folds down over the inwardly cut side edge portion 48*a* of side edge 48 of panel 14. The adhesive means portion 42*a* consequently is pressed into engagement with the adjacent correspondingly underlying top portion of sealing flap 30. The remaining portion of adhesive means 42*a* not overlying cutout 48*a* engages the adjacent underlying portion of panel 14 so that the lefthand end portion or side edge portion of locking flap 40 as seen in FIG. 2 is securely affixed to both sealing flap 30 and panel 14 and which necessarily retains the upper portion of panel 14 in adjacent contact with the upper portion of sealing flap 30. This would be in addition to the sealing contact between panel 14 and sealing flap 30 provided by the adhesive area 44.**

As can be further understood from viewing FIGS. 1 and 2 together an opening is defined between the top edges 20 and 38 of panels 12 and 14 respectively since both edges are nonsealed with respect to one another and a pocket is formed therebelow which essentially comprises the interior of the envelope. It is to be also noted that the tuck flap 22 is offset from an imaginary longitudinal centerline of the envelope, the offset being in a direction towards the common fold line 16 between the panels 12 and 14. Similarly, side edge 26 of closure flap 18 is substantially cut inwardly towards such imaginary centerline of the envelope, all of the purposes of which will be described hereinbelow.

Turning to the series of FIGS. 3–5, closing of the envelope in a nonadhesive manner will be described. The closure flap 18, as viewed in FIG. 3, is initially folded downwardly towards panel 14 and the tuck flap 22 having a leading curvilinear edge **22*a*, is similarly urged in a downward direction towards panel 14. Simultaneously therewith the unsecured side edge or end portion 40*a* of locking flap 40 is bent up or lifted up slightly to receive tuck flap 22. As viewed in FIGS. 4 and 5, the closure flap 18 includes a wider dimension than the underlying locking flap 40 so that the fold line 24 between the tuck flap and closure flap becomes positioned downwardly of the lower edge of locking flap 40. With this arrangement and with the tuck flap 22 being offset from the centerline of the envelope towards the unsecured portion 40*a* of the locking flap, the curvilinear leading edge 22*a* of the tuck flap is easily received underneath the unsecured end portion of the locking flap. It is to be appreciated that the engagement of the tuck flap underneath the unsecured portion of the locking flap can be accomplished with greatly improved facility when compared to prior art envelopes not including the flexibility of the locking flap described therein. A similar degree of increased facility is provided for opening the envelope constituting the present invention. As clearly seen in FIGS. 4 and in the plan view of FIG. 1, the side edge 40*a* of the locking flap is cut substantially inwardly. A user of the envelope merely has to place his finger underneath the inwardly cut side edge 26 of closure flap 18 and urge his finger in a direction toward the unsecured end portion 40*a* of the locking flap. In so doing, the closure flap and necessarily the tuck flap 22 are urged upwardly so that the tuck flap 22** springs out of engagement from underneath the unsecured portion of the locking flap. During such procedure, the unsecured portion of the locking flap temporarily flexes upwardly to allow such release of the tuck flap and then at least partially returns to its normal disposition. By such arrangement it is possible, should one desire, to reuse the envelope of the present invention by merely repeating the aforesaid closing and opening procedures.

From the foregoing, it is apparent that the objects of the present invention have been fully accomplished. As a result of this invention, an improved self-locking envelope is provided which has a locking flap assembly which can be engaged in a nonadhesive manner. The locking flap disclosed herein is so arranged to provide for a secured engagement of the envelope closure flap and tuck flap in an improved manner and with corresponding ease also being provided for opening the envelope of the present invention.

I claim:

1. An envelope formed of a single sheet of paper or the like, comprising:

a first panel having a top and a bottom edge and two side edges, a second panel, said second panel having a top and a bottom edge and two side edges and being folded into juxtaposed position with respect to said first panel, said corresponding top edges of said panels defining an opening therebetween and the remaining corresponding edges not including a common fold line between said panels being adhesively joined together whereby to define a pocket below said opening, a locking flap attached along said top edge of said first panel, said locking flap being down folded from said attached top edge in over-lapping, adjacent relation to the upper portion of said first panel, and at one side edge portion of said locking flap there being adhesive means of such extent as only to secure said locking flap at said one side edge portion to the correspondingly adjacent, underlying portion of said envelope with the opposite side edge portion of said locking flap being unsecured with respect to the correspondingly adjacent, underlying portion of said envelope, a closure flap having an inner edge and an outer edge, said closure flap being attached along said inner edge to and extending from said top edge of said second panel; and a tuck flap, said tuck flap being attached to and extending from said outer edge of said closure flap and being off-set from the longitudinal centerline of said envelope toward said unsecured opposite side edge portion of said locking flap so that said tuck flap is insertable under said unsecured side edge portion of said locking flap when said closure flap is juxtaposed to said locking flap.

2. The structure according to claim 1 in which one of said panels includes sealing flaps along the edges thereof not forming a common fold line with the other of said panels, said sealing flaps being adhesively joined to correspondingly adjacent edge portions of the other of said panels.

3. The structure according to claim 1 in which said closure flap is substantially trapezoidal in shape with said outer edge thereof being substantially parallel to said inner edge thereof and said outer edge of said closure flap being offset from the longitudinal centerline of said envelope towards said unsecured opposite side edge portion of said locking flap.

4. The structure according to claim 3 in which the width of said closure flap is appreciably greater than the width of said locking flap.

5. The structure according to claim 3 in which said tuck flap is curvilinear in form.

6. The structure according to claim 3 in which a portion of said side edge of said first panel underneath said secured side edge portion of said locking flap is cut away to expose portions of said adhesive means joining said side edge portion of said locking flap to said adjacent, underlying envelope portion to at least two different adjacent, underlying portions of said envelope.

7. The structure according to claim 3 in which said unsecured side edge portion of said locking flap is cut inwardly from said adjacent side edge portion of said first panel.

* * * * *